US005605768A

United States Patent [19]

Furukawa et al.

[11] Patent Number: 5,605,768

[45] Date of Patent: Feb. 25, 1997

[54] MAGNETIC MARKER AND MANUFACTURING METHOD THEREFOR

[75] Inventors: Shinji Furukawa; Kazuki Oka, both of Kyoto; Nobuyoshi Yano; Toshiyuki Hirano, both of Uji; Isamu Ogasawara, Otsu, all of Japan

[73] Assignee: Unitika Ltd., Hyogo, Japan

[21] Appl. No.: 568,432

[22] Filed: Dec. 6, 1995

[30] Foreign Application Priority Data

Dec. 8, 1994 [JP] Japan ..... 6-304721

[51] Int. Cl.[6] ..... G08B 13/24

[52] U.S. Cl. ..... 428/611; 428/928; 340/551; 340/572; 156/272.4

[58] Field of Search ..... 428/607, 611, 428/686, 928, 626; 340/551, 572; 148/108, 518; 204/192.2; 156/272.4, 269, 272.2

[56] References Cited

U.S. PATENT DOCUMENTS

| | | | |
|---|---|---|---|
| 4,652,863 | 3/1987 | Hultman | 340/551 |
| 4,960,651 | 10/1990 | Pettigrew | 428/611 |
| 5,130,698 | 7/1992 | Rauscher | 340/551 |
| 5,181,020 | 1/1993 | Furukawa et al. | 428/900 |
| 5,181,021 | 1/1993 | Lee et al. | 340/572 |
| 5,519,379 | 5/1996 | Ho et al. | 340/551 |
| 5,538,803 | 7/1996 | Gambino et al. | 428/694 TM |

*Primary Examiner*—John Zimmerman
*Attorney, Agent, or Firm*—Wenderoth, Lind & Ponack

[57] ABSTRACT

A compact and superior magnetic marker for an electronics apparatus for surveillance of article comprises at one or more wire members and a plane member contacting substantially directly to each other. An angle of the magnetic easy axis of the plane member relative to the longitudinal direction of the wire member is between 40° and 90° to show large Barkhausen reversal. An influence of demagnetizing field can be reduced by using the simple structure. The magnetic marker can be produced continuously at a low cost.

17 Claims, 16 Drawing Sheets

MAGNETIC MARKER AND MANUFACTURING METHOD THEREFOR

BACKGROUND OF THE INVENTION

1. Field of the Invention

The present invention relates to an electronic article surveillance system or identification system wherein a magnetic marker is attached to a good and the good is surveilled or identified according to a signal generated by the magnetic marker, or in particular, to the magnetic marker and a manufacturing method therefor.

2. Description of the Prior Art

Recently, an electronic article surveillance or identification system are used widely in order to prevent theft of goods, to deal goods or the like. In such an apparatus, a special marker is attached to a good as an object, and the good is surveilled or identified by detecting a signal generated by the marker. A variety of detection signals has been developed, and an appropriate marker is selected according to a use. The apparatuses are distinguished mainly as follows: Those using a magnetization process of a special soft magnetic material, those using a steep impedance change at a fixed frequency of an LC resonance circuit, and those radiating special electromagnetic waves.

Among them, apparatuses using magnetic markers are used widely because markers, can be produced at a low cost. A steep magnetization change of a magnetic material is detected with a voltage induced in a detection coil. Oscillation due to magnetostriction, high permeability, square hysteresis of magnetization or the like is used for detection.

For example, Japanese Patent Publication 27958/1991 describes a system using a marker made of an amorphous metallic thin wire, and the marker uses square hysteresis of a magnetostrictive material. In the system, an alternating magnetic field as an enquiry signal is generated in a surveillance area, and a voltage induced in a detection coil according to magnetization of the metallic thin wire is recognized as a detection signal. In such a system, it is needed to distinguish the magnetic marker from a general magnetic material such as an iron plate of a shopping bag or the like by using a specified waveform of induced voltage. The magnetization along the longitudinal direction is very stable for the thin wire material, and the magnetization reverses very steeply at an instant when the external magnetic field attains a critical value. This very special characteristic, large Barkhausen reversal generates a very steep pulse voltage in the detection coil. Then, frequency of the induced voltage is analyzed, and the existence of the marker is recognized according to an amplitude and/or a ratio of a harmonic thereof, and it is decided if a warning is necessary or not.

These markers provided at first had a relatively large size, but recently compact marker are desired. However, a magnetic property of a magnetic material is closely related to its shape, and it is hard to produce a compact marker. For example, in the system mentioned above, an Fe-based amorphous thin wire of length of about 90 mm is used. Generally, when a magnetic material is magnetized, magnetic poles appear at two ends thereof, and a magnetic flux of a opposite direction to the applied magnetic field is generated from the magnetic poles, and it affects the magnetic material itself. This is called usually as demagnetizing field, and it operates as a resistance against the magnetization of the material along the applied magnetic field. In the above-mentioned metallic wire, magnetic properties are deteriorated due to demagnetizing magnetic field if its length is equal to or less than about 90 mm. The demagnetizing field increases with increase in a ratio of cross sectional area to length. Then, in order to reduce the effect of the demagnetizing field, a thinner wire may be used. However, as the diameter of the wire decreases, the total volume thereof decreases and a sufficient amount of magnetic flux cannot be obtained, and a voltage induced in the detection coil decreases. Then, the marker cannot be so narrow.

Japanese Patent laid open Publication discloses a method to solve this problem. As to a metallic thin wire, a demagnetizing field is generated due to free magnetic poles at two ends. Then, as shown in FIG. 3, the formation of magnetic poles at ends of the thin wire can be prevented by contacting soft magnetic plates at two ends of the metallic thin wire to combine magnetically the thin wire with the soft magnetic plates. The effect of demagnetizing field on the wire is reduced, and even a thinner wire can have sufficient good magnetic characteristics. It is described that the plates made of a soft magnetic material is preferably produced by cutting an amorphous metallic thin ribbon. As the sizes of the plates made of a soft magnetic material increase, a critical field for magnetization reversal increases. Then, it is described that a sum of the lengths of the two plates is equal to or less than 50% of a length of the wire. Such a marker can be produced for example. Amorphous thin ribbons which have been cut beforehand are supplied onto a continuous amorphous wire at appropriate positions, and they are guided between two films and layered by a roller.

As described above, a compact magnetic marker can be produced by providing plates made of a soft magnetic material at two ends of a metallic wire. However, a structure of the magnetic marker is complicated, and steps for manufacturing it becomes large. Then, it is desirable to provide a magnetic marker having a simpler structure and easy to be fabricated.

SUMMARY OF THE INVENTION

An object of the invention is to provide a compact magnetic marker used for an electronic article surveillance and/or identification system and a manufacturing method therefor.

A magnetic marker of the invention comprises a wire member made of a first magnetic material and a plane member made of a second magnetic material, the plane member having uniaxial magnetic anisotropy. The wire member contacts substantially to the plane member, and an angle $\theta$ of a magnetic easy axis of the plane member relative to a longitudinal direction of the wire member is between 40° and 90°. The angle is 0° when the wire member is parallel to the magnetic easy axis. It increases as the wire member becomes nonparallel to the magnetic easy axis, and it reaches finally to 90° when the wire member is perpendicular to the magnetic easy axis. The wire member can be magnetized in both longitudinal directions. Then, a slate with an angle $\theta$ is equivalent magnetically to a state with an angle $(180°-\theta)$ by reversing magnetization of the wire member or the plane member. For example 40° is equivalent to 140°. In this sense, the angle of the longitudinal direction of the wire relative to the magnetic easy axis of the plane member is specified between 0° and 90°, and it has a maximum at 90°.

In order to operate the magnetic marker effectively, the wire member is arranged to have the above-mentioned angle relative to the direction of magnetic anisotropy of the plane member to combine them magnetically. Especially, the magnetic marker operates well When the longitudinal direction of the wire member is perpendicular to the magnetic easy axis of the plane member. A substantially effective voltage is induced in a search coil according to a change in magnetic field along any direction in a plane including the plane member. Therefore, the magnetic marker can respond to an alternating magnetic field along all the direction in a plane including the magnetic marker. The wire member itself does not generate steep magnetization reversal due to demagnetizing field if its length is not sufficiently long. However, if such a wire member is combined with the plane member, steep magnetization reversal is possible to be used as a magnetic marker.

Preferably, the first magnetic material of the wire member or the second magnetic material of the plane member includes at least 50% of amorphous phase. Then, the wire member or the plane member has a magnetic property appropriate for a magnetic marker.

Preferably, the plane member comprises a film formed on a flexible substrate, the film having a thickness between 0.1 and 10 μm. If the thickness is equal to or less than 10 μm, a magnetic field at which magnetization reversal occurs is not so large, while if it is equal to or larger than 0.1 μm, the magnetic effect is sufficient large.

Preferably, the wire member contacts substantially to the plane member to cause large Barkhausen reversal against a change in external magnetic field. Thus, steep magnetization reversal is generated. Particularly, if both wire and plane members have large Barkhausen reversal, the magnetic marker responds steeply according to an alternating magnetic field along all the direction in a plane where the magnetic marker exists, and superior recognition property can be provided.

In a method for manufacturing a magnetic marker of the invention, a wire made of a first magnetic material is formed continuously. A continuous planar magnetic material (web) made of a second magnetic material which enable to have an uniaxial magnetic anisotropy is formed, and the magnetic easy axis of the web is induced to have an angle between 40° and 90° relative to a longitudinal direction of the wire. Next, the continuous wire is lapped on the web so that the wire contacts substantially to the plane member, and the continuous wire is adhered to the web with an adhesive agent or the like. Then, the continuous wire and web adhered to each other are cut in magnetic markers. Each magnetic marker comprises a wire member made of a part of the wire and a plane member made of a part of the web.

Because the magnetic easy axis of the plane member has an angle between 40° and 90° relative to the longitudinal direction of the wire, the web can also be supplied continuously, and markers can be produced very simply. If the angle is less than 40°, the marker produced has a bad property by layering the web material and the continuous wire in parallel. Then, it is needed to layer them by intersecting each other at an appropriate angle, but this makes it very difficult to produce markers continuously. The above-mentioned manufacturing method has no such difficulty. Preferably, in fixing the web and the continuous wire, a first adherent tape, a web, a continuous wire and a second adherent tape are supplied in parallel to overlap them by a roller due to adherence. Thus, the web and the continuous wire can be fixed to each other easily by contacting to each other substantially.

An advantage of a magnetic marker of the present invention is that a compact magnetic marker having superior properties can be provided with a simple structure.

An advantage of a manufacturing method of the invention is that the magnetic marker can be produced continuously by using an apparatus having a simple structure so that this method can be used commercially.

BRIEF DESCRIPTION OF THE DRAWINGS

These and other objects and features of the present invention will become clear from the following description taken in conjunction with the preferred embodiments thereof with reference to the accompanying drawings, and in which.

DETAILED DESCRIPTION OF THE PREFERRED EMBODIMENTS

First, as a comparison example, the inventors examine a magnetic marker where a wire (wire member) on a continuous soft magnetic ribbon. Amorphous alloy thin ribbons 2705M (Co-based alloy, no magnetostriction) and 2605S2 (Fe-based alloy, positive magnetostriction) of Allied Signal of thickness of about 20 μm are used as the soft magnetic thin ribbon. Though it is not subjected to annealing, the coercive force is as small as about 0.1 Oe, and no magnetic anisotropy is observed except that due to its shape. Though shapes of the ribbon and the wire and arrangement thereof are changed in various ways, a magnetic field of the magnetic marker necessary for the wire to reverse magnetization becomes very large, and it cannot be used practically as a marker. This is similar to a marker shown in the above-mentioned Japanese Patent laid open Publication 195384/1992 where the sizes of the soft magnetic pieces at two ends of the wire is 50% or more of the length of the wire. Therefore, a marker as a simple combination of a soft magnetic ribbon with a wire cannot be used.

The inventors further examine a marker as a combination of a wire with a soft magnetic thin film. In general, the magnetic thin film can be controlled its property according to deposition conditions. Then, besides the shapes of the thin film, various factors such as coercive force, saturation magnetic flux density, squareness of hysteresis, magnetic anisotropy or magnetic domain structure are also examined in detail. As a result, it is found that the effect of magnetic anisotropy is large especially. Further, it is also found that a marker having properties similar to those of previous markers can be obtained by using an appropriate structure, and the present invention can be attained.

Figure 1:
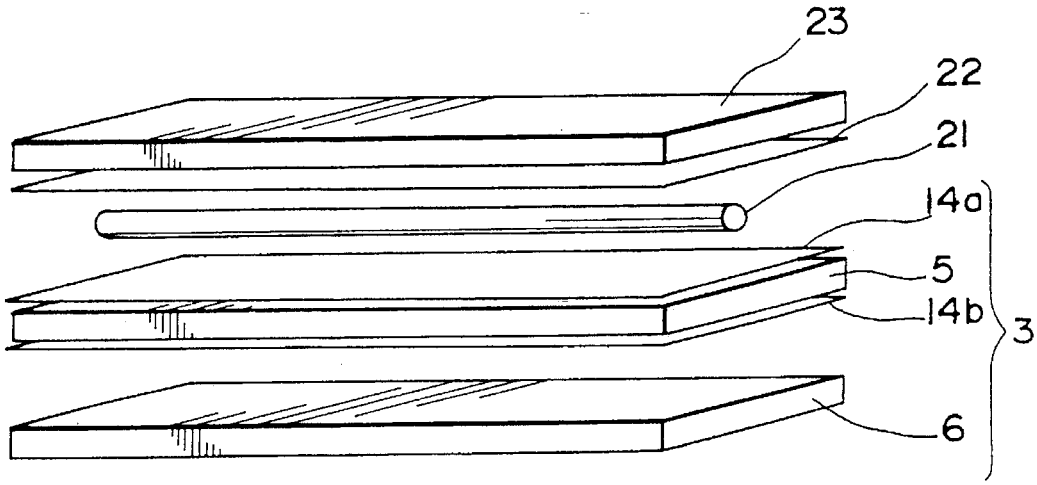
FIG. 1 is an exploded view of a magnetic marker of an embodiment of the invention.
Figure 2:
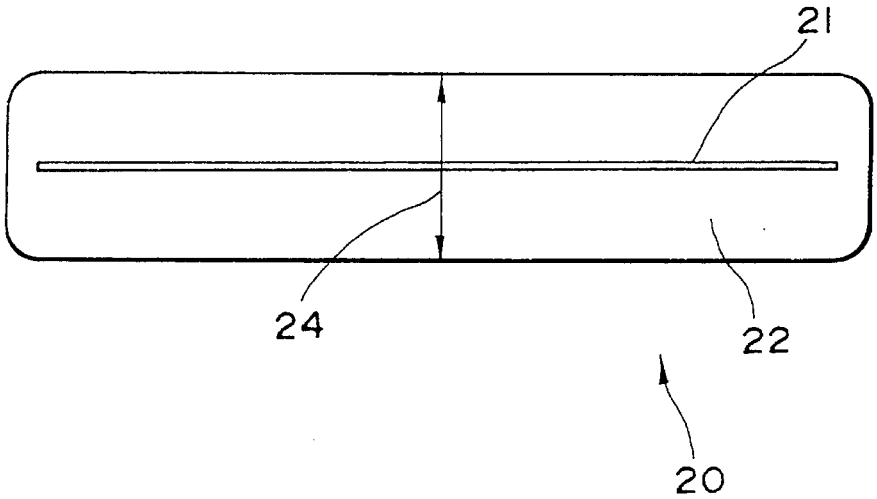
FIG. 2 is a diagram for illustrating a relation of the magnetic easy axis of the plane member of the magnetic marker of FIG. 1 to the longitudinal direction of the wire member.

Referring now to the drawings, wherein like reference characters designate like or corresponding parts throughout the several views, FIGS. 1 and 2 show a magnetic marker of an embodiment of the invention comprising a wire member 21 and plane member 22. An angle of the magnetic easy axis 24 of the plane member 22 relative to the longitudinal direction of the wire member 21 is between 40° and 90°(90 in an example shown in FIG. 2), and the two members 21 and 22 contact directly with each other. (As shown in the exploded view of FIG. 1, the wire member 21 and the plane member 22 are inserted between two films 23 and 3.)

The plane member 22 having uniaxial magnetic anisotropy is made of a magnetic material. In order to obtain a uniaxial magnetic material, orientation of crystal grains, deposition or annealing in magnetic field, application of uniaxial stress, patterning or the like is effective. For example, U.S. Pat. No. 5,181,020 describes a very simple method for controlling uniaxial magnetic anisotropy of thin film, wherein a cathode is arranged obliquely relative to a substrate when a thin film is deposited with sputtering. This can be used very simply for a flexible substrate.

The wire member 21 has to be arranged at an appropriate position on the anisotropy direction of the plane member 22 in order to operate effectively in the magnetic marker. It is needed that the wire member 21 is combined magnetically with the plane member 22. The magnetic marker operates well preferably when the magnetic easy axis of the plane member 22 is perpendicular to that of the wire member 21, while it does not operate practically when the magnetic easy axis of the plane member 22 is in parallel to that of the wire member 21. Between the two extreme cases, the magnetic marker operates well when the magnetic easy axis of the plane member 22 has an angle in a range between 40° and 90° relative to that of the wire member 21. In the magnetic marker of the embodiment, the magnetic easy axis of the wire member is generally in parallel to its longitudinal direction. Then, the magnetic marker of the embodiment is summarized as follows: In the magnetic marker, it is necessary that an angle of the axis 24 of easy magnetization of the plane member 22 relative to the longitudinal direction of the wire member 21 has a value between 40° and 90°. In order to use the plane member 22 with the wire member 21, it is preferable that the angle has a value between 60° and 90°, and most preferable that he angle is 90°. The magnetic easy axis can be measured with a torque meter, a B-H tracer or the like by changing a direction of applied magnetic field. In the embodiment, average magnetic properties of the materials rather than local and precise ones are important factors, and anisotropy dispersion due to skew or ripples are allowed to some degree. Therefore, the above-mentioned measurement can be adopted. The invention will be explained below by using measured values obtained with a B-H tracer.

Magnetic materials for the wire and plane members 21 and 22 may be an amorphous material as well as a crystalline material such as a permalloy. Especially, an amorphous material is superior in that it has a small coercive force and that magnetic anisotropy can be controlled easily by magnetic field annealing. It is preferable that the wire member 12 and/or the plane member 22 comprises at least an amorphous material of 50% or more. If an amount of the amorphous material is 50% or more, magnetic properties appropriate for the magnetic marker can be obtained.

Further, magnetostriction can be controlled from positive to negative one by controlling the composition, and a material having a steep magnetization reversal can be obtained by an appropriate processing. For example, an Fe-based amorphous metallic wire described in Japanese Patent Publication 27958/1991 has a large positive magnetostriction of $10^{-5}$ or more, and magnetization along the normal and reverse directions on the longitudinal direction becomes very stable by realizing a special magnetic domain structure. Large Barkhausen reversal is induced by the magnetic domain structure. Large Barkhausen reversal is also observed in amorphous thin ribbons and amorphous thin films besides the above-mentioned amorphous wires, as described in U.S. Pat. Nos. 4,980,670 and 5,181,020. Several mechanisms are known to generate the large Barkhausen reversal, and it is observed for materials having positive, zero and negative magnetostriction. In the embodiment, it is very preferable to use a material having large Barkhausen reversal. Especially, the wire member and the plane member are made of magnetic materials having large Barkhausen reversal, steep magnetization reversal occurs for a external magnetic field along any direction in a plane including the magnetic marker, and a detection signal is generated. This is ascribed to that the magnetic easy axis of the wire and plane members crosses each other in the magnetic marker of the invention. In case of a prior art magnetic marker comprising only a wire or a prior art magnetic marker comprising a wire and plate pieces at two ends of the wire, if a magnetic field is applied along a direction perpendicular to the wire, magnetization reversal does not occur. This causes a dead angle in a surveillance area. Then, this problem is solved by using a special coil to generate magnetic fields along various directions. The magnetic marker responds to a magnetic field along all the direction and has no such problem, or it needs no special coil.

In the embodiment, it is needed that the wire member 21 and the plane member 22 need to contact to each other to be combined magnetically, and a sheet or the like should not be inserted between them. However, it is effective to apply a coating of oil, or the like to the wire member 21 in order to prevent an unnecessary stress to the wire member 21, and this is included in a scope of the invention. In this sense, the wire member 21 and the plane member 22 contact substantially directly to each other. A magnetic marker of this embodiment comprises a wire member 21 made of a metallic thin wire of circular cross section, a metallic ribbon having a very narrow width, a metallic thin film made with patterning or the like, and a plane member 22 made of a metallic thin ribbon or a metallic thin film, the wire member 21 being applied directly to the plane member 22. However, when the plane member 22 is made of a metallic ribbon, a shape or characteristic thereof has to be determined carefully. As described later on a third comparison example, when a wire is lapped on an amorphous metallic thin ribbon of thickness of 20 μm without giving magnetic anisotropy, a magnetic field needed to reverse magnetization becomes too large to be used as a magnetic marker practically. This phenomenon can be avoided by decreasing the thickness of the thin ribbon or by giving strong magnetic anisotropy. Though the metallic thin ribbon may be used as the plane member 22, it is not easy to decrease the thickness of the thin ribbon or to give strong magnetic anisotropy. Then, preferably, the plane member 22 comprises a metallic thin film, and the wire member 21 comprises a metallic wire having a circular cross section. Especially, an amorphous metallic wire has superior soft magnetic properties, and it can be formed to decrease diameter form about 200 μm to several m easily by using die drawing. Further, an amorphous metallic wire having magnetostriction has better squareness of magnetization hysteresis than that having zero magnetostriction, and can be used effectively in a magnetic marker.

A thin film used as the plane member 22 has no effect if its thickness is too thin, while a thick film having a thickness larger than 10 μm is not desirable because the critical magnetic field of magnetization reversal of the wire becomes large. The thickness of the thin film has a value preferably between 0.2 and 5 μm, more preferably between 0.3 and 2 μm because the amount of expensive thin film can be reduced while a sufficient advantage as the magnetic marker can be obtained. Then, most preferably, a metallic thin film formed on a flexible substrate such as polymer and having a thickness of 0.1–10 μm is contacted directly to an amorphous wire having a magnetostriction and adhered with a pressure sensitive adhesive.

The above-mentioned magnetic marker comprises one wire member and one plane member. Next, a magnetic marker comprising a plurality of wire member and one plane member is explained. In an example shown in FIG. 19, a magnetic marker comprises two magnetic wires 45' and 45" and one magnetic thin film 48. In this embodiment, because the magnetic marker comprises a plurality of wire member, it can add high functions. As explained above, a wire member reverses magnetization according to an external magnetic field to generate a magnetic pulse as a signal to be detected. If a plurality of wire member is included in the magnetic marker, a plurality of magnetic pulses is generated. In order to detect each magnetic pulse of the wire member independently of each other, a timing to generate the pulse is changed, and this is controlled by changing a magnetic field needed for magnetization reversal. The demagnetizing field of the wire member depends on the composition thereof, production conditions, annealing and the like. It depends on the length even the same material is used. Further, if thin wire members are arranged on the plane member as in this embodiment, the wire member interact with each other, and there is a tendency that the magnetic pulses are separated. Thus, the pulse signals can be controlled relatively easily. The plurality of magnetic pulses improves a performance of correct identification by the marker remarkably. Magnetic pulse signals of a predetermined number and at different timings, responding to an alternating magnetic field generated in a surveillance area, can be discriminated easily from noise signals due to other magnetic material such as an iron plate. It is also possible to add identity to a marker by using a plurality of magnetic pulse signals. Recognition signals of a few to a few tens of bits can be generated by changing a combination of a plurality of wire member or by controlling a number of magnetic pulses and timings to be responded. Such a marker is advantageous for a system for selecting goods without contact. It is an advantage of the marker that the above-mentioned high functions can be realized by using a simple structure where a plurality of wire members is arranged on a plane member.

The magnetic marker explained above is manufactured by a new method as will be explained below. In this manufacturing method, uniaxial magnetic anisotropy is given to a continuous web made of a magnetic material so that an angle of magnetic easy axis of the web relative to a longitudinal direction of a web is between 40° and 90°. Next, the continuous wire is lapped on the web to contact substantially to each other. Then, the continuous wire is fixed to the web with a pressure sensitive adhesive or an adhesive agent. Then, the continuous wire and the web are cut in desired sizes. The manufacturing method will be explained below in detail.

In the manufacturing method, first, a continuous wire and a web are provided. Next, uniaxial magnetic anisotropy is given to the web. The web is, for example, a metallic ribbon or thin film which will be used as the plane member of a magnetic marker after cutting. When the uniaxial magnetic anisotropy is given, a magnetic easy axis of the web has an angle between 40° and 90° relative to a longitudinal direction of the web. There is no restriction on the inducement of the uniaxial magnetic anisotropy. For example, it is effective for a thin film to apply a magnetic field on deposition, or to arrange apparatus for deposition so that evaporated particles deposit obliquely. Annealing in applied magnetic field or under applied stress to a metallic thin film or ribbon is also advantageous to induce good uniaxial magnetic anisotropy. As to permalloy, it is known that uniaxial magnetic anisotropy is induced by rolling. Uniaxial magnetic anisotropy can be induced along a desired direction by using these processes. Further, such a web can also be produced by cutting a material having a direction not specified to satisfy the above-mentioned condition.

Figure 3:
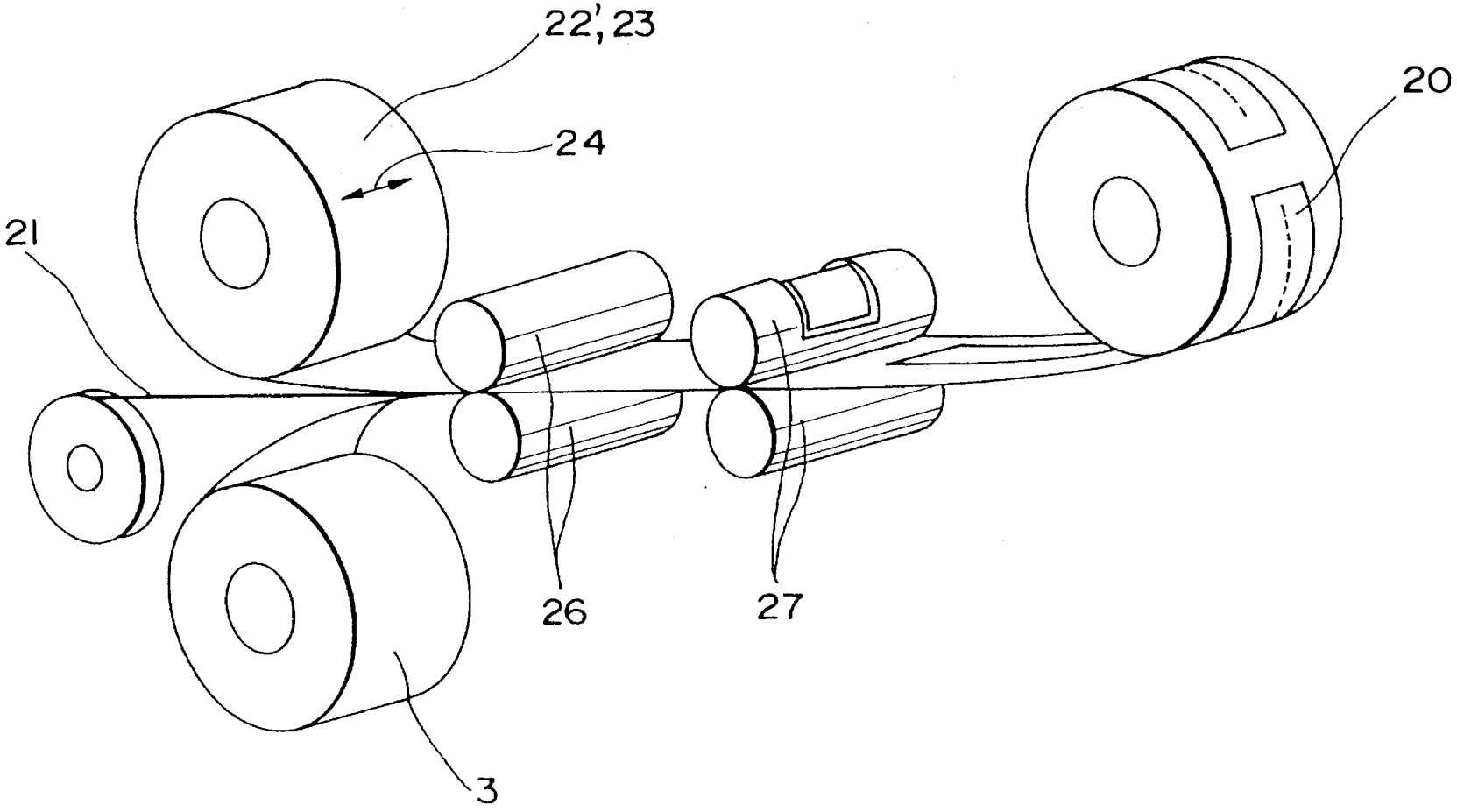
FIG. 3 is a perspective schematic view of an apparatus for manufacturing the markers shown in FIGS. 1 and 2.

Next, the continuous wire is lapped on the web. If the web comprises a magnetic thin film, the marker can be manufactured with an apparatus, for example, as shown in FIG. 3. A sheet 23, a wire 21' for forming the wire member and another sheet 3 are supplied in parallel. A magnetic thin film 22' has been formed on a side of the sheet (flexible substrate) 23 to which the wire 21' contacts directly (refer to FIG. 2), and the magnetic easy axis 24 of the magnetic thin film has an angle between 40° and 90° relative to a longitudinal direction of the sheet 23. As shown in FIG. 1, the sheet 3 is a double side pressure sensitive adhesive tape comprising a base 5 having adhesives 14*a*, 14*b* applied to two sides thereof, and a separation paper 6 at the lower side thereof. The metallic wire 21' is located between the films 3 and 23, and they are layered together by a pair of rollers 26. The layered sheets are supplied further to be cut at desired pattern by a pair of cut rollers 27 and wound on a bobbin. A user in a shop or the like separates a marker 20 from the separation paper 6 and sticks it to a good to be detected. The marker 20 comprises a wire member 21 made of a portion cut from the wire 21' and a plane member 22 made of a portion cut from the magnetic thin film 22' If a magnetic marker is used as a tag without adherence, a single-side pressure sensitive adhesive tape may be used for the film 3.

Figure 4:
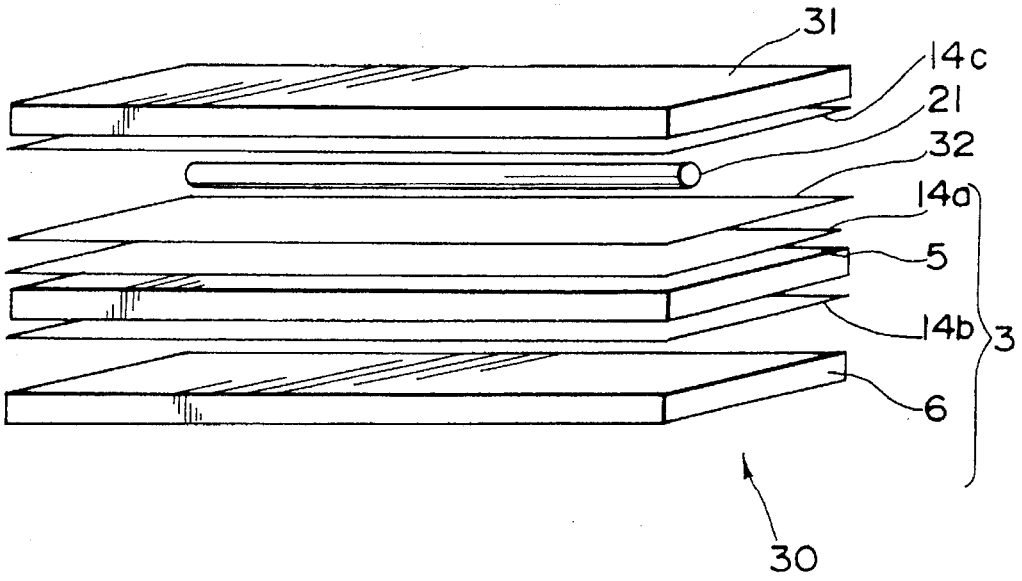
FIG. 4 is an exploded view of a magnetic marker of another embodiment of the invention.
Figure 5:
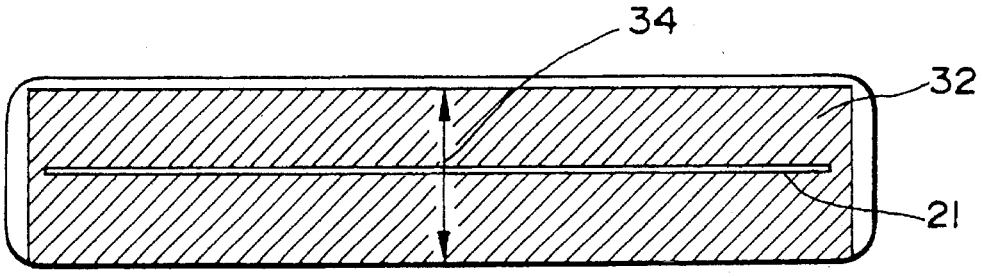
FIG. 5 is a diagram for illustrating a relation of the magnetic easy axis of the plane member (magnetic thin ribbon) of the magnetic marker of FIG. 4 to the longitudinal direction of the wire member.

FIGS. 4 and 5 show an example of a magnetic marker comprising a magnetic ribbon as the plane member. As shown in FIG. 4, the marker has a structure where a wire member 21 is lapped on a plane member 32 and they are further interposed by sheets 3 and 31. The sheet 31 has a pressure sensitive adhesive tape 33 applied to a side facing the wire member 21. The magnetic easy axis 34 (FIG. 5) of the plane member 32 has an angle between 40° and 90° relative to a longitudinal direction of the wire 21o The sheet 3 is a double side pressure sensitive adhesive tape similar to that shown in FIG. 1.

Figure 6:
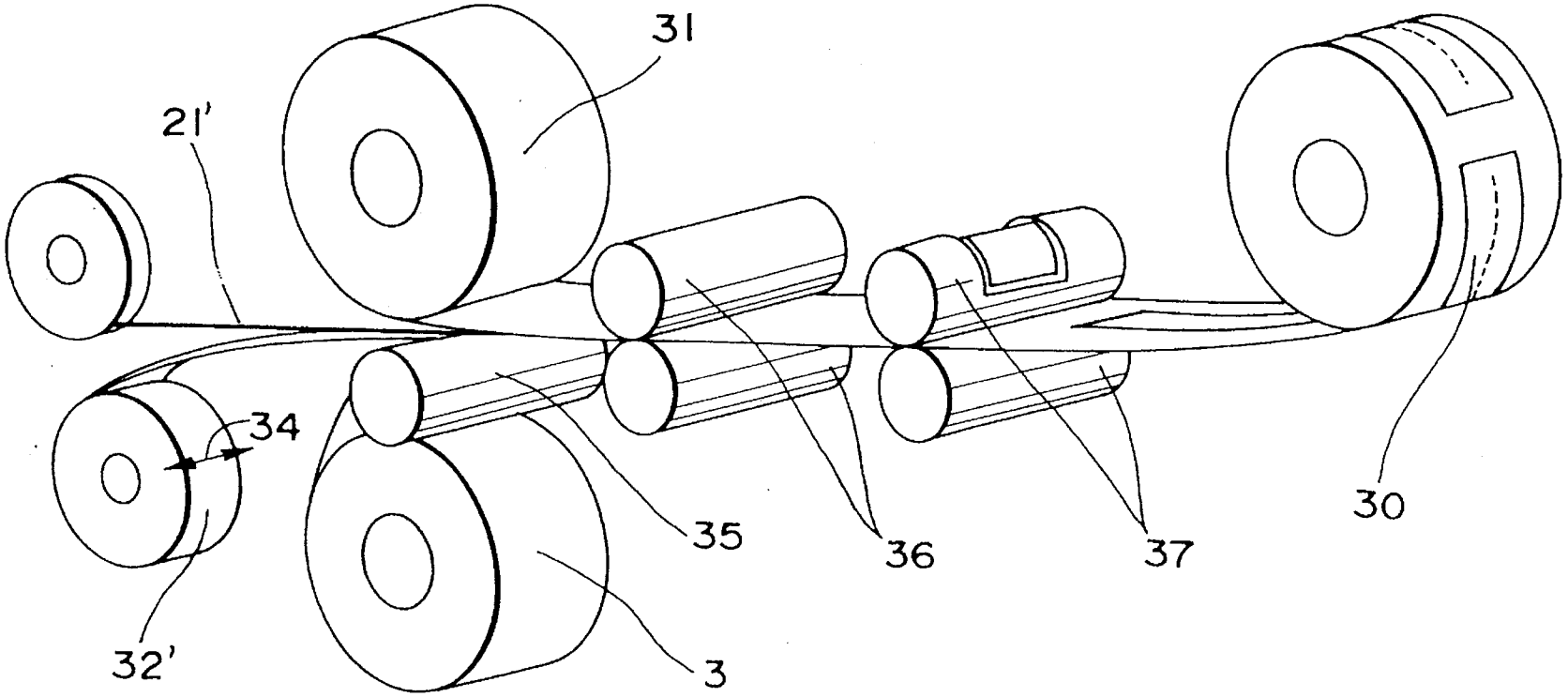
FIG. 6 is a perspective schematic view of an apparatus for manufacturing the markers shown in FIGS. 4 and 5.

As shown in FIG. 6, when the magnetic marker is manufactured, a sheet 31, a wire 21' of a circular cross section for the wire members, a magnetic thin ribbon 32' for the plane members and another sheet 3 are supplied in parallel. A roller 35 is arranged oppositely to a bobbin of the sheet 31. Then, they are layered by a pair of rollers 36, cut at desired patterns by a pair of cut rollers 37 and wound on a bobbin shown at the right side in FIG. 6. A user in a shop or the like removes one of the markers 30 from the separation paper 6 and sticks it to a good. The marker 30 comprises a wire member 21 made of a portion cut from the wire 21' and a plane member 32 made of a portion cut from the magnetic ribbon 32'.

FIGS. 3 and show apparatuses for manufacturing an linear array of magnetic markers. However, a plurality of linear arrays of magnetic markers can be manufactured if a plurality of wires 21 are supplied in parallel and a number of blades to be put in the cutting roller corresponds to the number of the wires 21. This enhances production speed.

Examples of magnetic markers are explained below.

EXAMPLE 1

Figure 7:
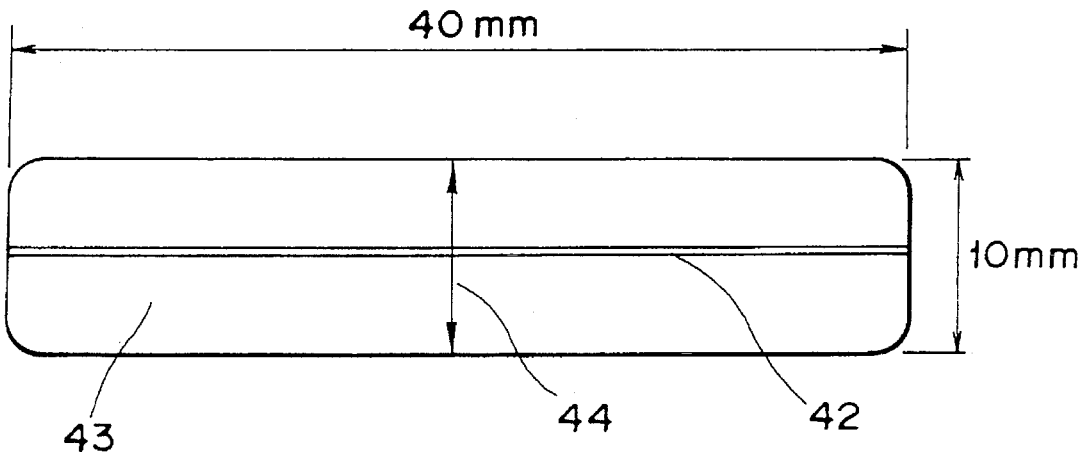
FIG. 7 is a diagram of a marker of an embodiment of the invention.

A marker shown in FIG. 7 is manufactured by using a metallic thin film and a metallic thin wire for the plane member and the wire member. The marker comprises a plane member 43 made of a metallic thin film and a wire member 42 made of a metallic wire. The thin film has a thickness of 1.0 μm and a composition of $(Co_{0.94}Fe_{0.06})_{72.5}Si_{12.5}B_{15}$ (atomic percent), and it is deposited by sputtering on a polyethylene telephthalate (PET) substrate of thickness of 50 μm with applying a magnetic field generated by permanent magnets. The PET substrate with the thin film is cut to have a length of 40 mm and a width of 10 mm so that the longitudinal direction of the metallic wire is perpendicular to the magnetic easy axis of the metallic thin film. On the other hand, the metallic wire of $(Co_{0.5}Fe_{0.5})_{78}Si_7B_{15}$ (atomic percent) having a diameter of 125 μm is produced with an apparatus by melt spinning in rotating water, and it is processed to a wire of diameter of 100 μm by cold die drawing. Then, it is cut to have a length of 40 mm to be used as the wire member. The apparatus is described for example in Japanese Patent Publication 9906/1989. The metallic thin film and the metallic wire are identified as an amorphous phase with an X ray diffraction apparatus of Rigaku Denki model RAD-rB. The wire member 42 and the plane member 43 are combined so as to contact directly with each other by arranging their longitudinal directions in parallel. The wire member 42 is placed at the center of the PET substrate, and it is fixed by adhering a single side pressure sensitive adhesive tape (Scotch mending tape 810 of Sumitomo-3M) thereon.

Figure 8:
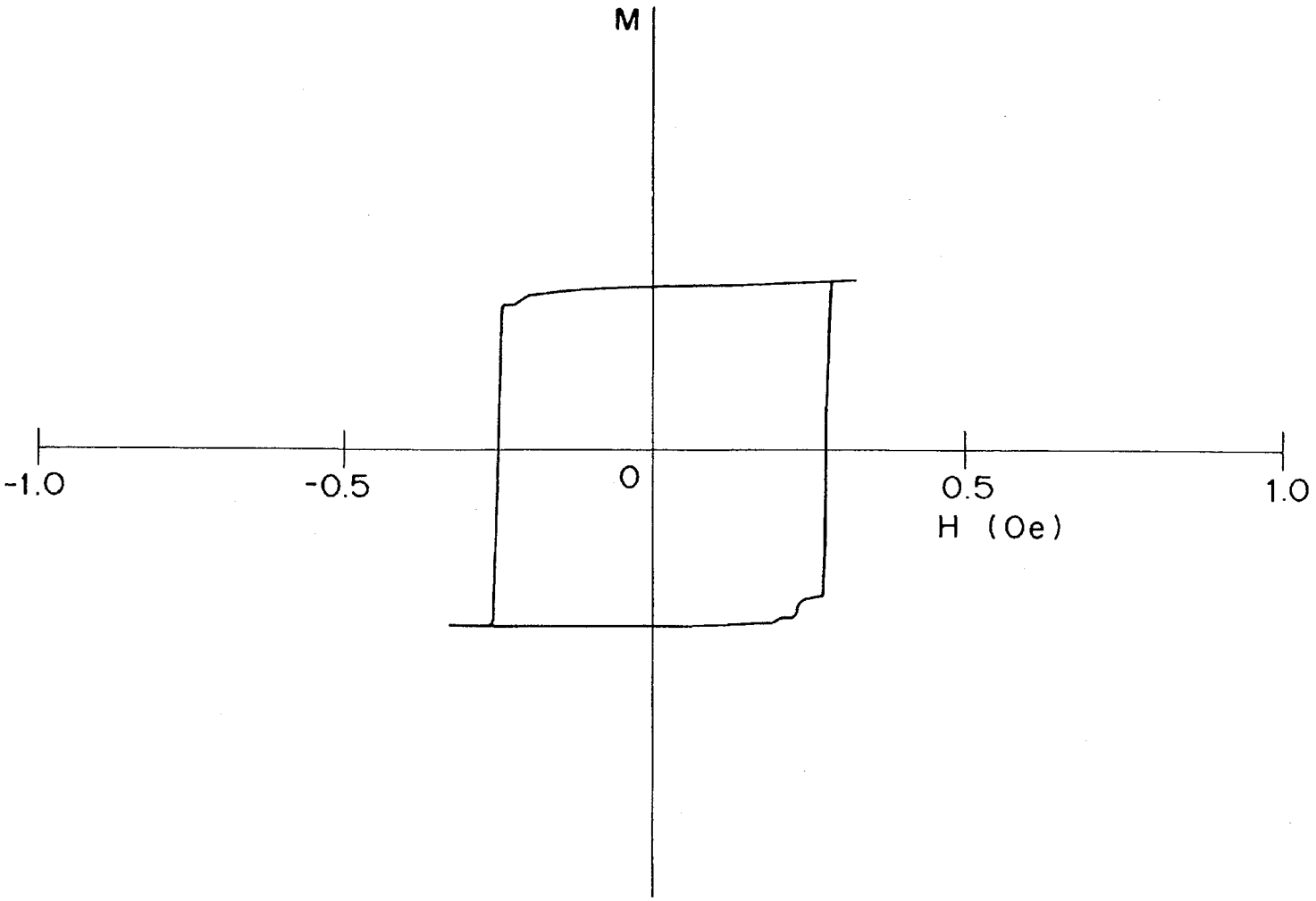
FIG. 8 is a graph of alternating magnetization of the marker shown in FIG. 7.
Figure 9:
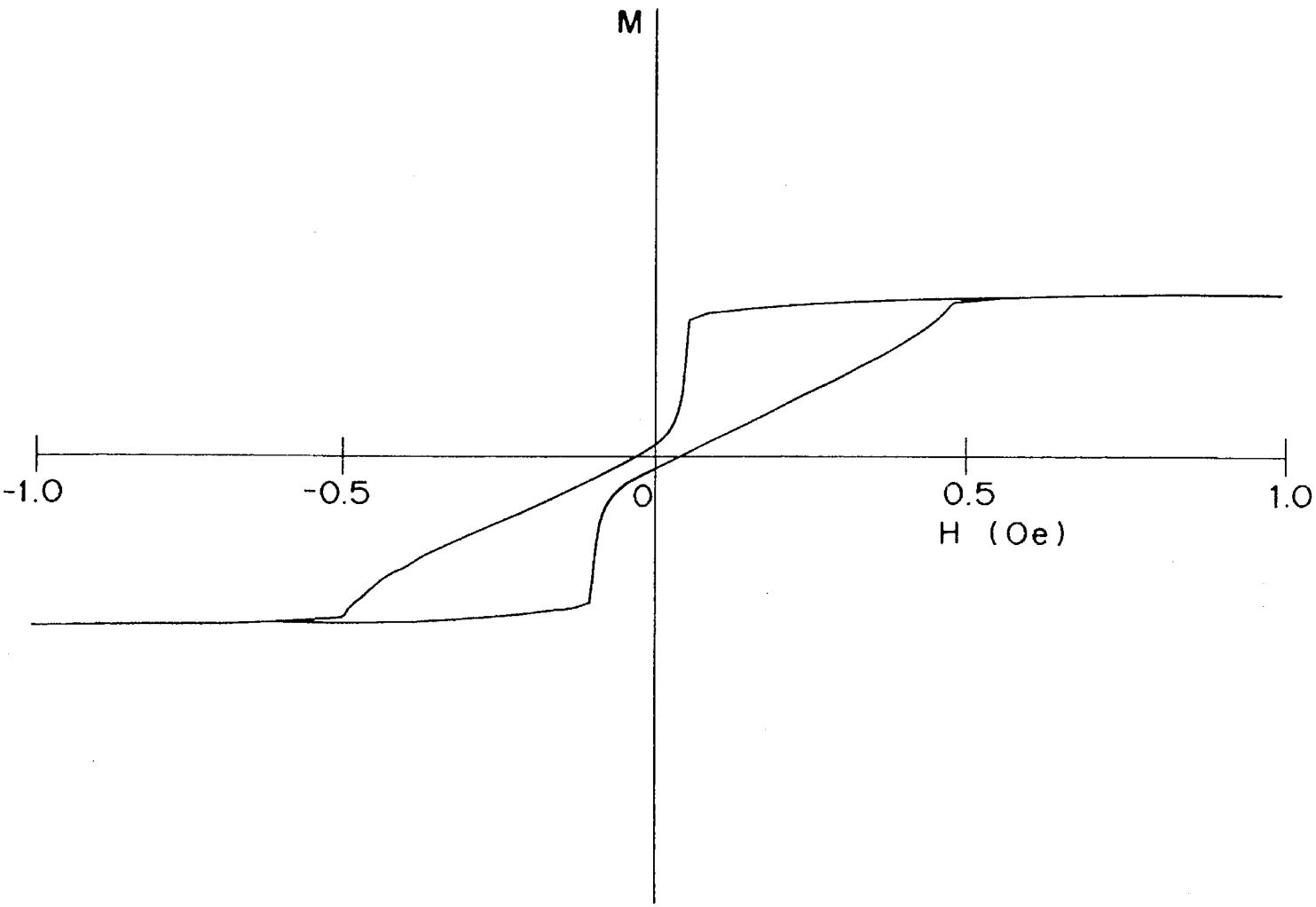
FIG. 9 is a graph of alternating magnetization of the wire used in the marker shown in FIG. 7.
Figure 10:
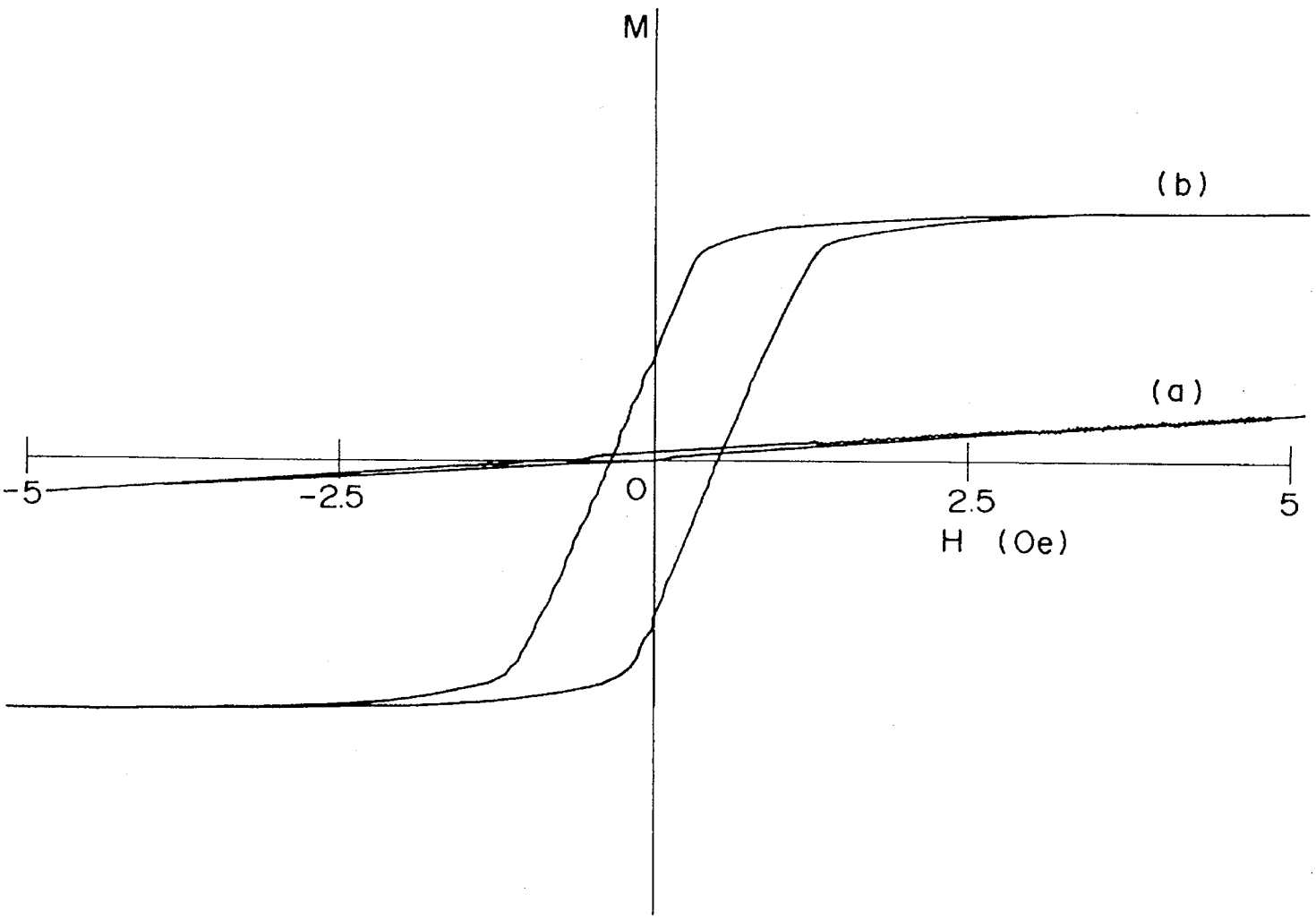
FIG. 10 is a graph of alternating magnetization of the magnetic thin film used in the marker shown in FIG. 7 along the longitudinal direction and along the width direction.

Magnetic characteristics of the marker produced as described above are measured with an alternating B-H tracer o AC, BH-100K of Riken Denshi at 60 Hz, and frequencies of magnetic pulses are analyzed with a dynamic signal analyzer 3562A of Hewlett Packard at 50 Hz and at 1 Oe of alternating magnetic field. FIG. 8 shows magnetization of the marker when an alternating magnetic field of 60 Hz is applied along the longitudinal direction, wherein the ordinate represents magnetization. The marker shows very steep Large Barkhausen reversal at 0.26 Oe. FIG. 9 shows BH loop when magnetic properties of only the wire (wire member 42) used in the marker is measured along the longitudinal direction. It is apparent that it becomes harder to be magnetized due to the influence of the demagnetizing field and large Barkhausen reversal is prevented. FIG. 10 shows magnetic characteristic of only the thin film (the plane member 43) (a) along the longitudinal direction and (b) along the width direction, measured similarly. It is apparent that the magnetic easy axis 44 is perpendicular to the longitudinal direction of the wire. Therefore, it is found that even if the short wire (wire member 42) having bad magnetic properties by itself (refer to FIG. 9) is combined with a thin film (the plane member 43) having magnetic hard axis (refer to FIG. 10), an influence of demagnetizing field is reduced and Large Barkhausen reversal is realized.

Figure 11:
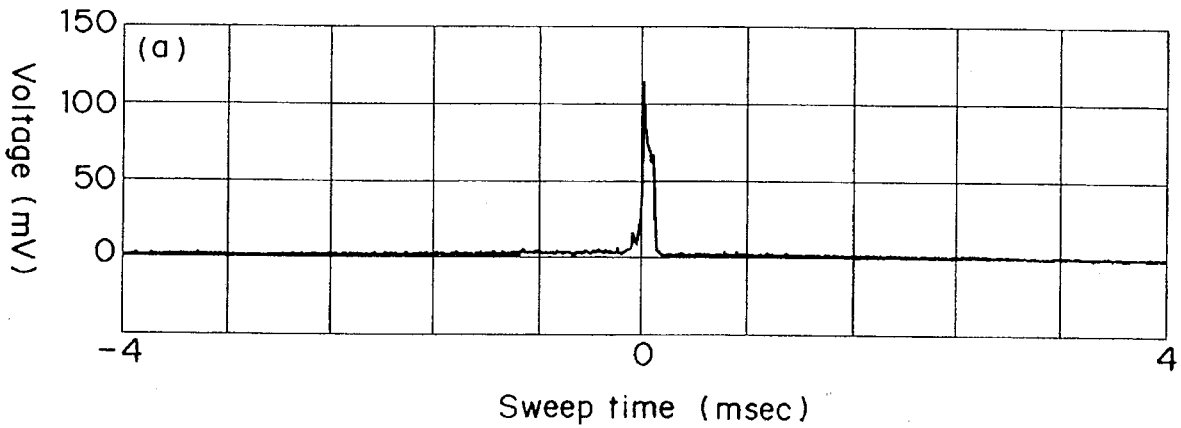
FIG. 11 is a graph of a characteristic of magnetic pulses (waveform of induced voltage in a search coil) of the marker shown in FIG. 7 in an alternating magnetic field.
Figure 12:
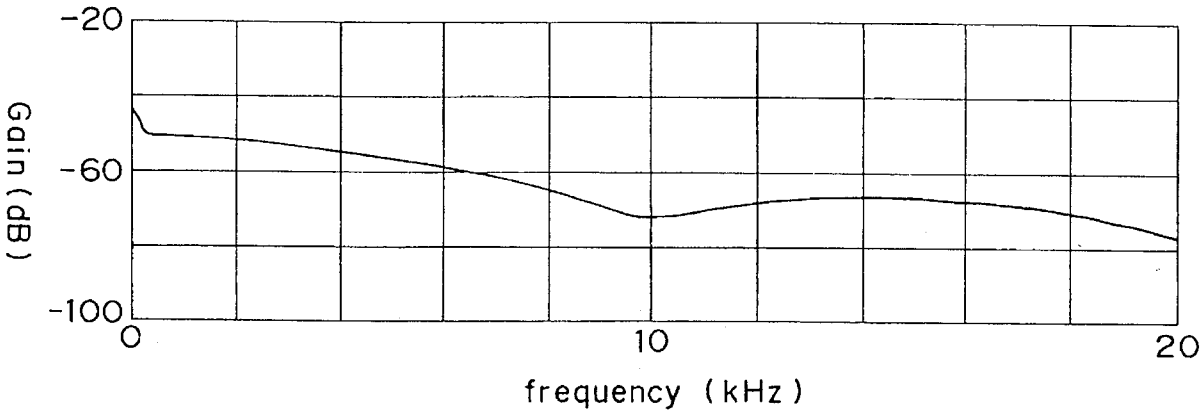
FIG. 12 is a graph of frequency characteristics obtained by Fourier analysis of a waveform of a voltage induced in a search coil shown in FIG. 11.

Next, magnetic pulses of a marker under an alternating magnetic field of 1 Oe of 50 Hz are evaluated from a voltage induced in a search coil wound around the marker. A waveform of the magnetic pulses are subjected to Fourier analysis for frequency analysis, and an amplitude of a harmonic and the like are analyzed. FIGS. 11 and 12 show some results. FIG. 11 shows a waveform of the induced voltage, and a very steep single pulse is observed. FIG. 12 shows Fourier analysis of the pulse shown in FIG. 11, and this shows that very higher harmonics are observed. On the other hand, when only the wire 42 is measured, the induced voltage comprises a plurality of waveforms, and amplitudes of signals of high frequencies are very small. That is, bad signals are observed.

As explained above, a compact superior magnetic marker can be obtained by contacting the wire member and the plane member with each other so that magnetic easy axis thereof are perpendicular to each other.

COMPARISON EXAMPLE 1

Figure 13:
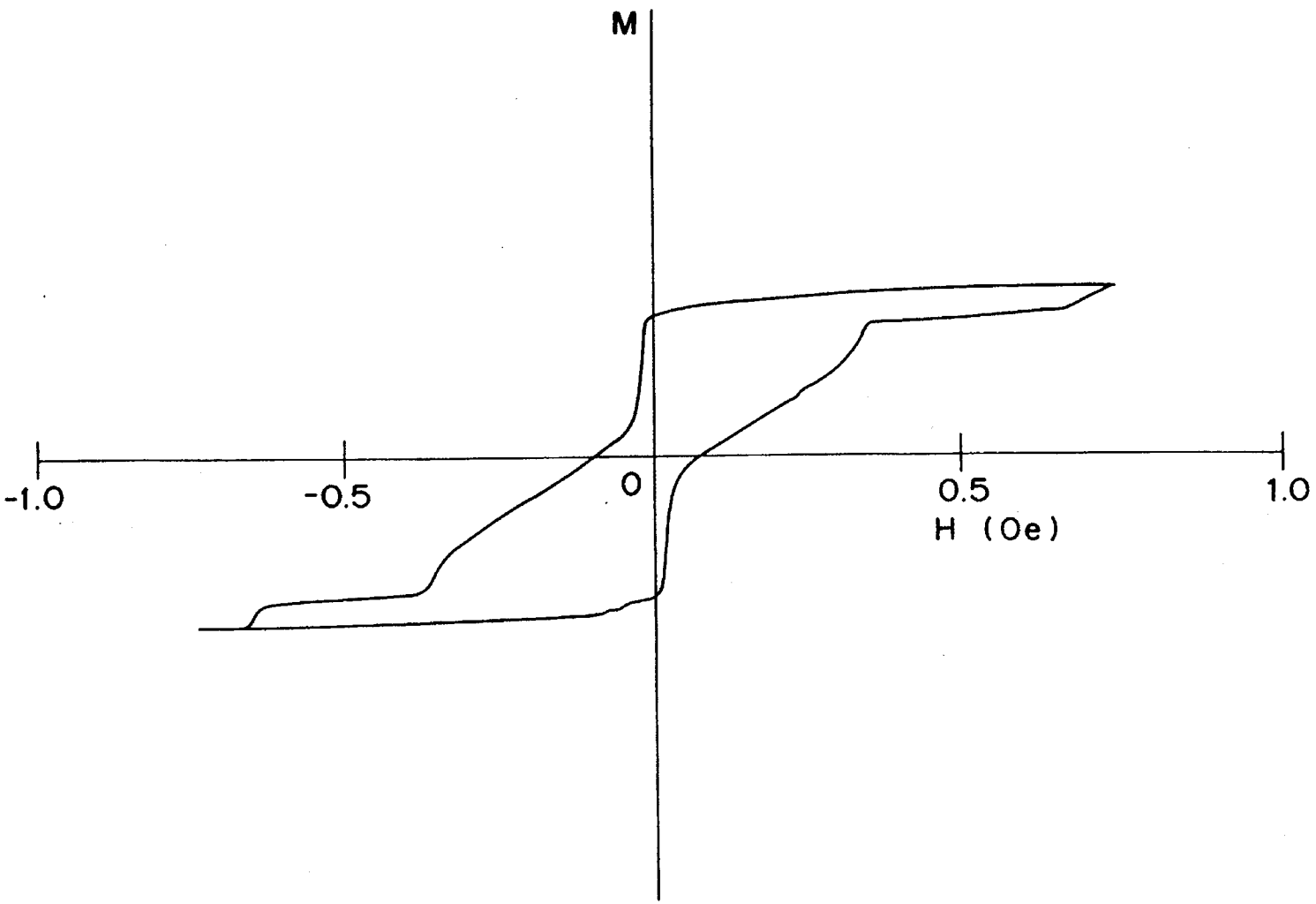
FIG. 13 is a graph of alternating magnetization of a marker of a first comparison example.

A marker is manufactured similarly to Example 1 except that magnetic easy axis thereof are in parallel to each other. FIG. 13 shows magnetization property of the marker when an alternating magnetic field of 60 Hz is applied along the longitudinal direction thereof. The ordinate represents magnetization. The magnetization property is almost the same as that of only the thin wire shown in FIG. 9, and an advantage of the combination with the thin film is not observed. That is, if magnetic easy axis thereof are in parallel to each other, a marker of good characteristic cannot be obtained when the size of the thin wire becomes small.

EXAMPLE 2 AND COMPARISON EXAMPLE 2

Figure 14:
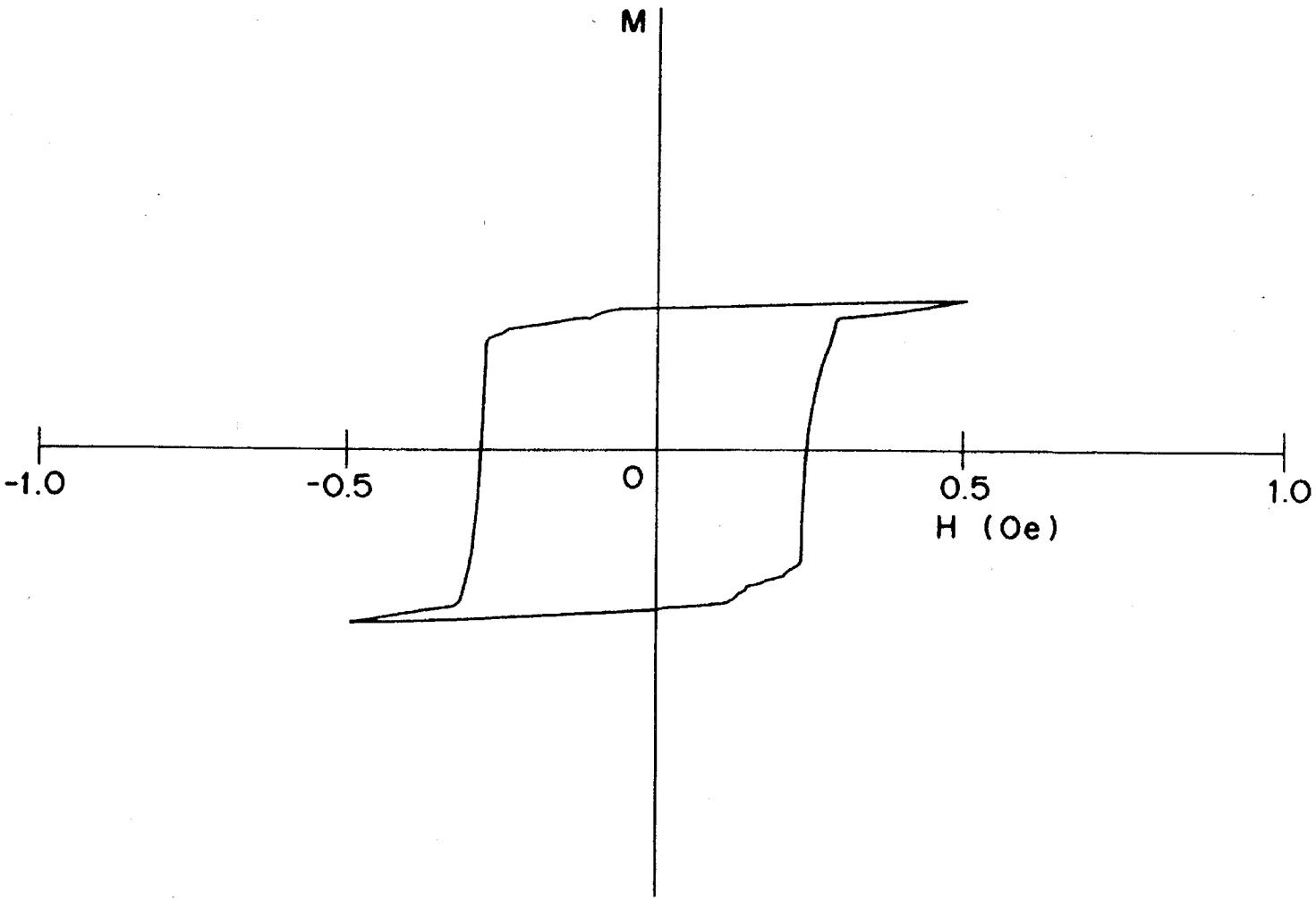
FIG. 14 is a graph of alternating magnetization of a marker of the invention.
Figure 15:
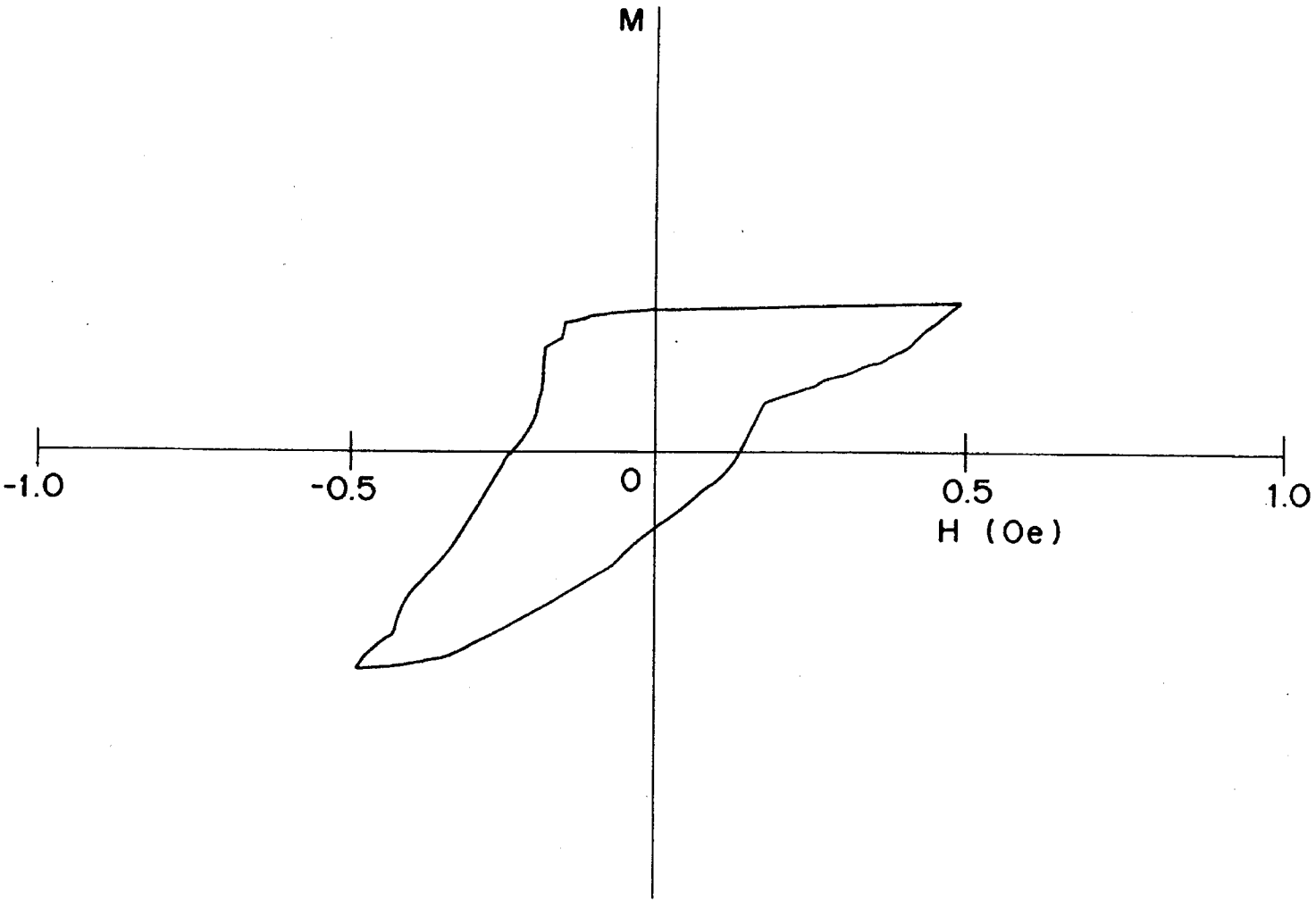
FIG. 15 is a graph of alternating magnetization of a marker of a second comparison example.

Markers are manufactured similarly to Example 1 except that an angle of the magnetic easy axis of the plane member 43 relative to the longitudinal direction of the wire member 42 is changed from 10° to 80°. Magnetic characteristic is measured by applying an alternating magnetic field of 60 Hz along the longitudinal direction of these magnetic markers. In a range between 40° and 80°, the magnetization is reversed steeply at almost one stage, similarly to Example 1. On the contrary, if the angle becomes smaller than 40°, the magnetization of the wire member 42 changes at a plurality of steps, going toward a continuous magnetization change. FIGS. 14 and 15 show alternating magnetization characteristic at 30° and at 40°, wherein the ordinate represents magnetization. At angles of 40° (FIG. 14) or more, discontinuous characteristic is observed, similarly to Example 1, whereas at angles of 30° (FIG. 15) or less, the magnetization reversal is gradual, and the squareness is deteriorated. These data shows that a compact superior magnetic marker can be obtained by contacting the wire member and the plane member with each other so that an angle of the magnetic easy axis of the wire member relative to that of the plane member is between 40° and 90°.

COMPARISON EXAMPLE 3

Figure 16:
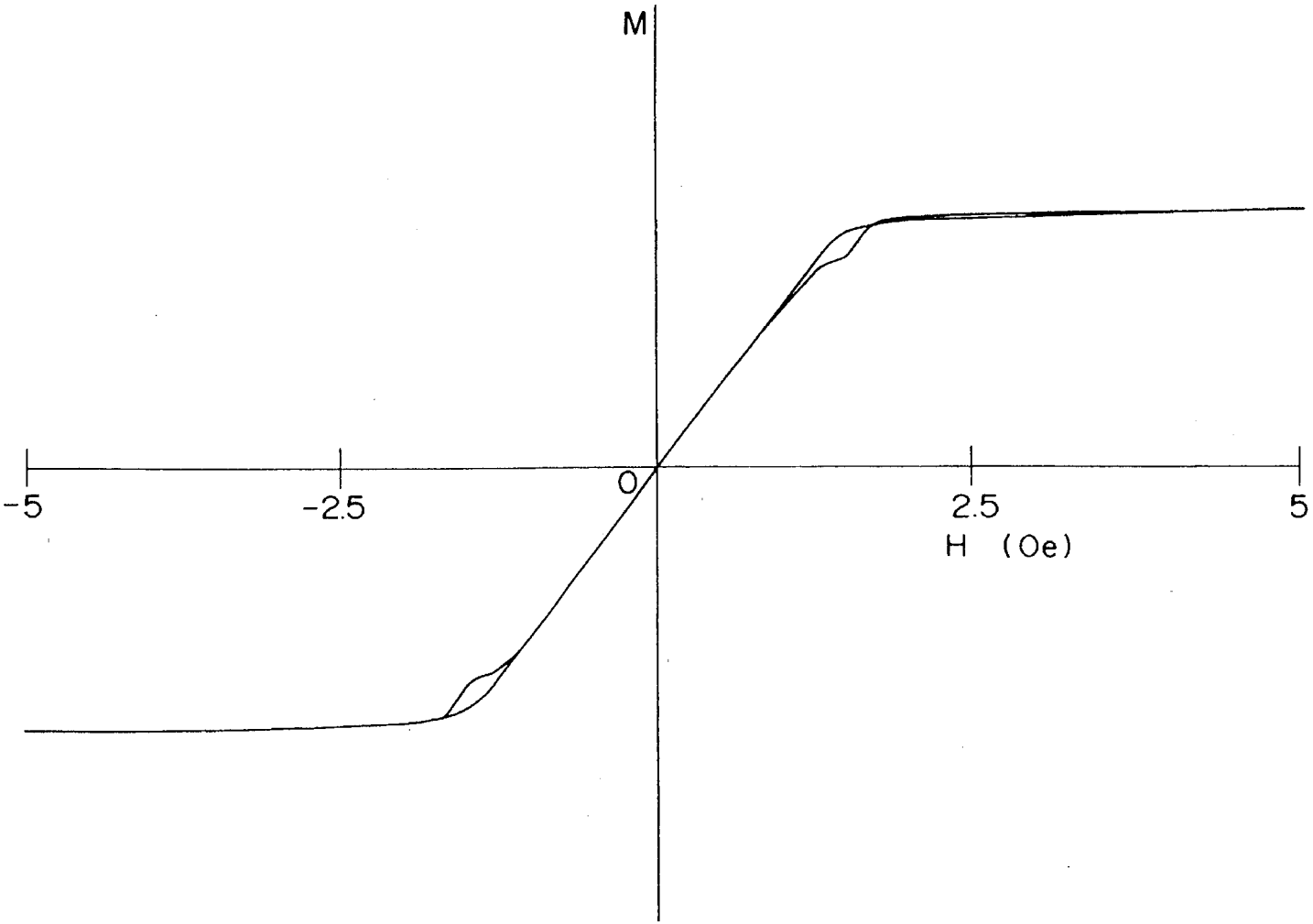
FIG. 16 is a graph of alternating magnetization of a marker of a third comparison example.

An amorphous Co-based alloy ribbon MBF-2705M of Allied Signal is cut along a roll direction by 40 mm of length and 10 mm of width, to be used as the plane member. It has a thickness of about 20 μm, and the material itself has no magnetic anisotropy except slight anisotropy due to its shape. A wire of 40 mm of length used in Example 1 is put at the center of the ribbon by aligning their longitudinal directions in parallel, and they are fixed with a Scotch tape. Magnetic characteristic of the marker is measured by applying alternating magnetic field of 60 Hz along the longitudinal direction of the marker. As shown in FIG. 16, because the thin ribbon having a volume as large as several tens times that of the marker of Example 1 is magnetized at the same time, a change of magnetization becomes smaller relatively, and a magnetic field needed to reverse the magnetization of the wire increases to 1.5 Oe. This means that a large change in magnetic field is needed to generate a detection signal, or a performance as a magnetic marker is deteriorated. Thus, a compact superior magnetic marker cannot be obtained as a combination of a thin wire with a thin ribbon having almost no magnetic anisotropy.

EXAMPLE 3

Figure 17:
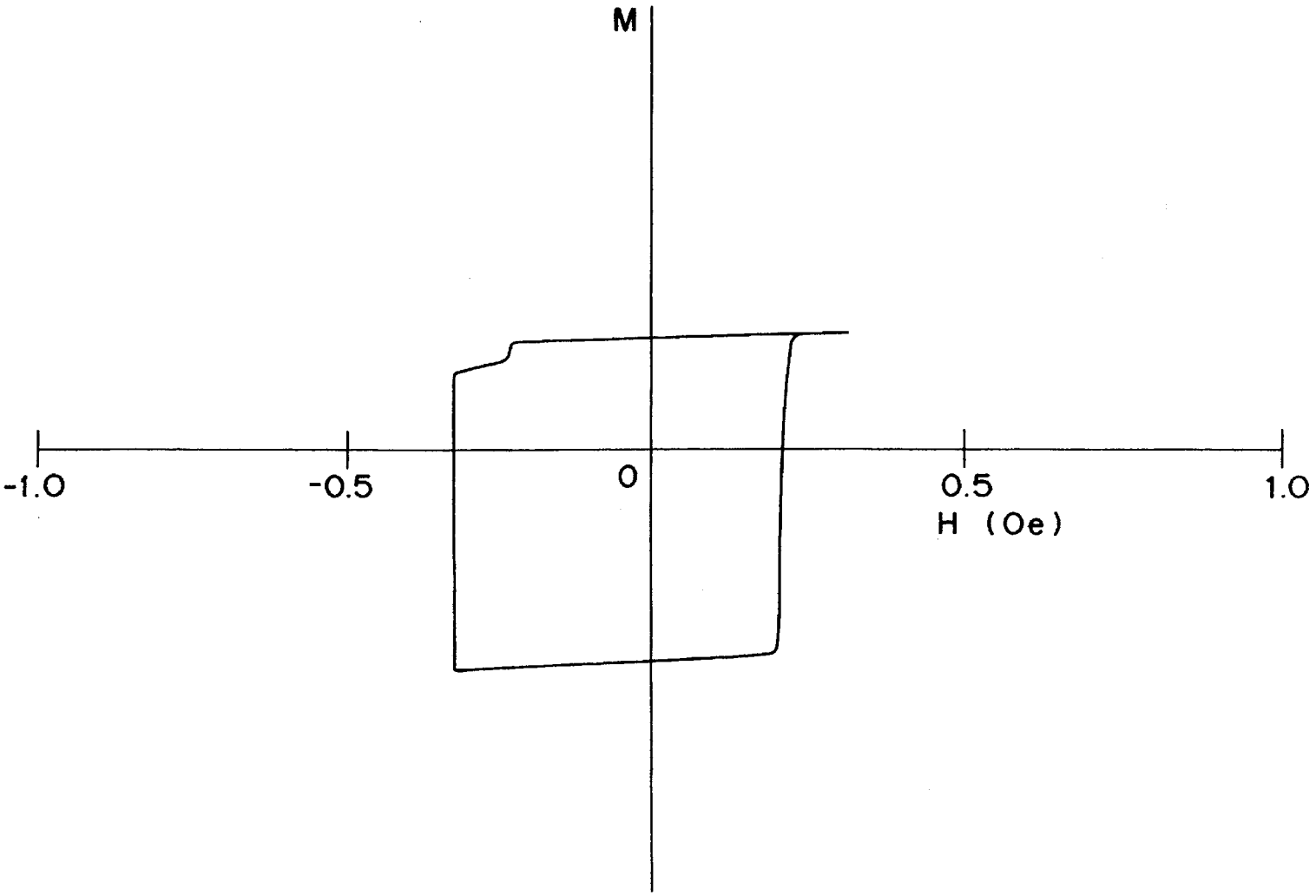
FIG. 17 is a graph of alternating magnetization of a marker comprising a wire member and a plane member.

A magnetic marker shown in FIG. 7 is manufactured by using a thin wire of $(Co_{0.5}Fe_{0.5})_{78}Si_7B_{15}$ (atomic percent) of diameter of 100 μm and length of 35 mm, as the wire member 42, and a permalloy thin film of width of 15 mm and length of 40 mm, as the plane member 43. The permalloy thin film is prepared to a thickness of 0.5 μm on a polyethylene telephthalate substrate of thickness of 125 μm using DC sputtering in magnetic field with a $Ni_{70}Fe_{30}$ (atomic percent) target. The longitudinal direction of the wire member 42 is perpendicular to the magnetic easy axis of the plane member 43. FIG. 17 shows alternating magnetization property along the longitudinal direction of the magnetic marker. Large Barkhausen reversal is obtained by combining the wire member 42 with the plane member 43, and a performance as the magnetic marker is improved. That is, even if the plane member comprises a crystalline material, a compact superior magnetic marker can be obtained by using an appropriate direction of magnetic anisotropy.

EXAMPLE 4

Figure 18:
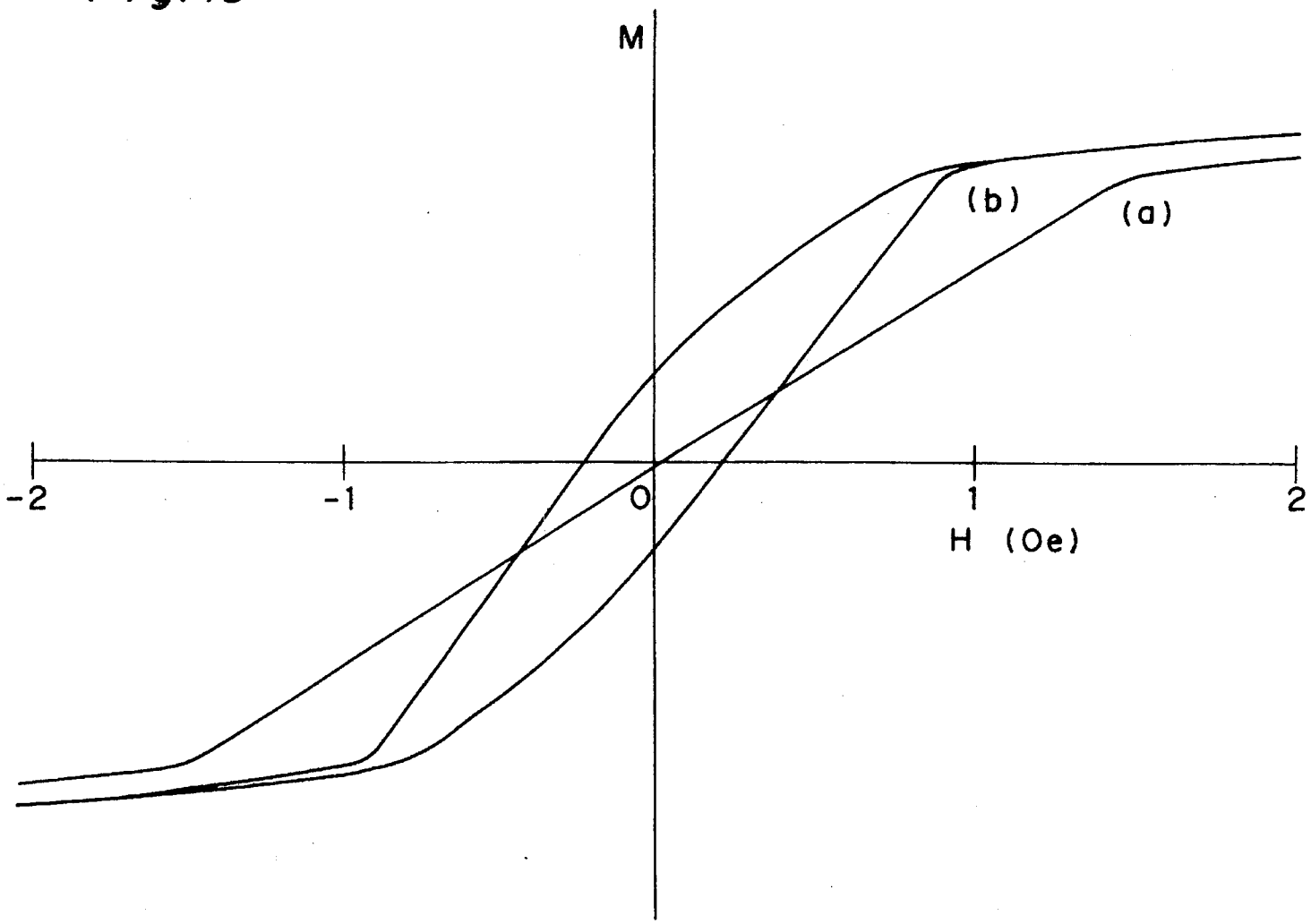
FIG. 18 is a graph of alternating magnetization (a) of a ribbon as a wire member and of alternating magnetization (b) of a marker of the invention comprising a wire member and a plane member.

A magnetic marker shown in FIG. 7 is manufactured by using an amorphous ribbon as the wire member 42 and a permalloy thin film as the plane member 43. The wire member 42 is an amorphous Co-based alloy thin ribbon MBF-2705M of Allied Signal which is cut by 20 mm of length and 1 mm of width. The plane member 43 is a $Ni_{70}Fe_{30}$ (atomic percent) thin film of thickness of 1 μm, width of 10 mm and length of 40 mm. By putting the ribbon directly on the thin film, and they are fixed with a single-side adherent tape. At this time, the thin ribbon is arranged perpendicular to the magnetic easy axis of the thin film. FIG. 18 shows alternating magnetization characteristic (b) along the longitudinal direction of the marker. For comparison, alternating magnetization characteristic (a) along the longitudinal direction of only the ribbon (wire member) before combining with the magnetic thin film. It is observed that the magnetic characteristic (a) of the wire member, wherein magnetization is hard due to demagnetizing field before combination, changes almost to halve the saturation field by the combination with the plane member 43, or a performance as the marker is improved.

EXAMPLE 5

Figure 19:
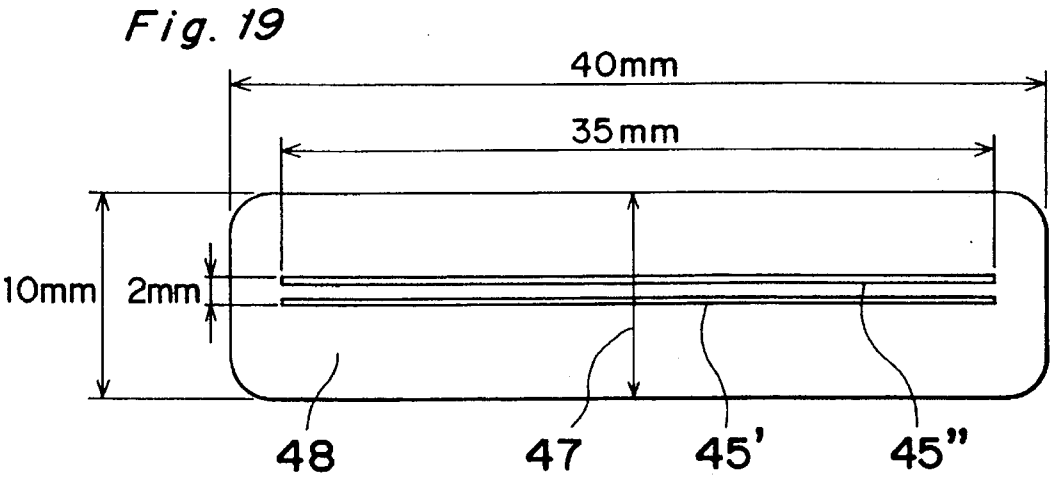
FIG. 19 is a diagram of a magnetic marker comprising two wire members and a plane member.
Figure 20:
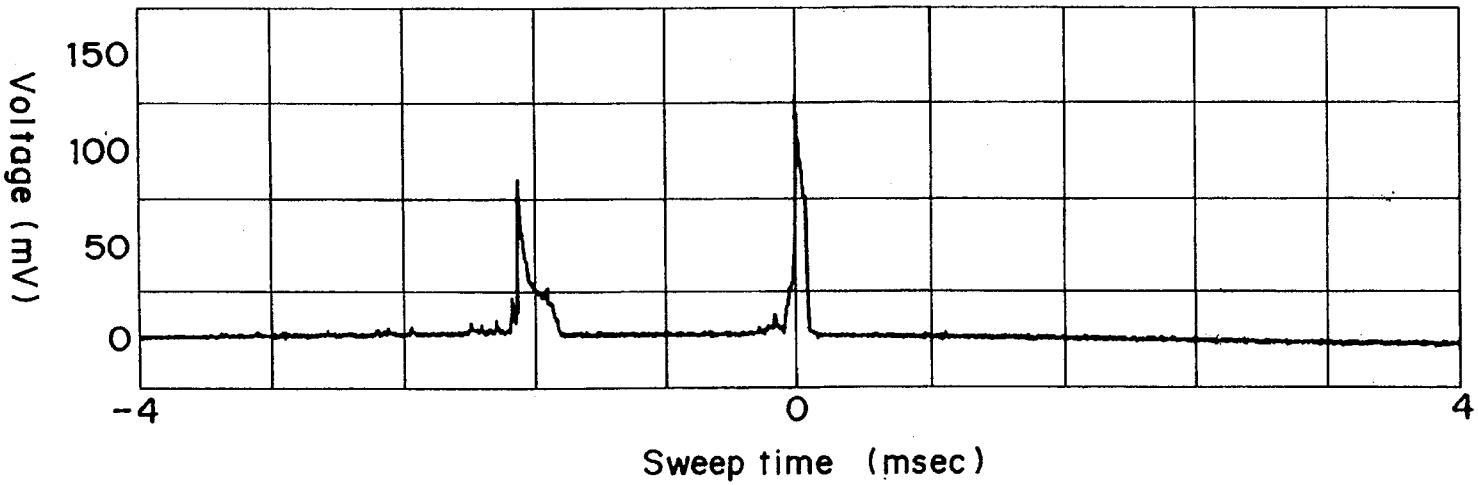
FIG. 20 is a graph of alternating magnetization of the marker shown in FIG. 19.

A magnetic marker shown in FIG. 19 is manufactured by using two wire members and one sheet of a plane member. The wire members 45' and 45" are amorphous wires of $(Co_{0.5}Fe_{0.5})_{78}Si_7B_{15}$ (atomic percent) of diameter of 100 μm and length of 35 mm. A $Ni_{70}Fe_{30}$ (atomic percent) permalloy thin film of thickness of 0.5 μm is prepared on a PET substrate of thickness of 100 μm, as the plane member 43, and it is cut by 40 mm times 10 mm so that the width direction agrees to the magnetic easy axis 47. The two thin wires 45' and 45" are put with a distance of 2 mm along the longitudinal direction of the thin film 48, and they are fixed with a single side adherent tape. FIG. 20 shows a waveform of a magnetic pulse induced in a search coil when an alternating magnetic field of 50 Hz of 1 Oe is applied. Two steep pulse voltages are generated with a time distance of about 2 msec. The two pulses can be distinguished easily because each pulse signal is sufficiently clear. Because magnetic pulses having good signal characteristics are detected independently of each other, a number of pulses and time distances between them are also used as an information besides the amplitude of harmonic signals. Therefore, recognition performance of the marker is improved remarkably if compared with a marker comprising one wire member. As explained above, by contacting a plurality of wire members with a plane member so that the magnetic easy axis of the wire magnets are perpendicular to that of the plane member, a plurality of independent magnetic pulses is generated, and a compact superior magnetic marker can be obtained.

EXAMPLE 6

Magnetic markers are manufactured by using the apparatus shown in FIG. 3. The sheet 23 shown in FIG. 3 is a polyethylene telephthalate (PET) substrate of thickness of 50 μm, and an amorphous thin film 22' of $(Co_{0.94}Fe_{0.06})_{72.5}Si_{12.5}B_{15}$ (atomic percent) of thickness of 0.5 μm is formed thereon. The wire 21' is an amorphous wire of $(Co_{0.5}Fe_{0.5})_{78}Si_7B_{15}$ (atomic percent) of diameter of 100 μm. These corresponds to the counterparts used in Example 1. The sheet 3 is a double side adherent tape applied with an adherent agent and attached with separation papers at both sides. Though not shown in FIG. 3, the paper at the upper side is removed when the sheet 3 is supplied, but the paper at the lower side is kept to be attached. These materials are supplied in parallel from each bobbin, adhered by the roller, cut at a rectangular pattern of length of 40 mm and width of 10 mm by the cut rollers and wound on the bobbin. A sheet of the magnetic marker 20 is removed from the layered tape manufactured as explained above, and magnetic properties thereof is measured. A good performance as in Example 1 is observed.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A magnetic marker comprising at least one wire member made of a first magnetic material and a plane member made of a second magnetic material, said plane member having uniaxial magnetic anisotropy, wherein said wire member contacts substantially to said plane member and an angle of magnetic easy axis of said plane member relative to a longitudinal direction of said wire member is between 40° and 90°.

2. The magnetic marker according to claim 1, further comprising two sheets interposing said wire and plane members.

3. The magnetic marker according to claim 2, wherein one of the two sheets comprises a separation paper for separation of the magnetic marker, the paper being provided at a side not in contact with said wire and plane members.

4. The magnetic marker according to claim 1, wherein the angle is between 60° and 90°.

5. The magnetic marker according to claim 4, wherein the angle is 90°.

6. The magnetic marker according to claim 1, wherein the first magnetic material of said wire member includes at least 50% of amorphous phase.

7. The magnetic marker according to claim 6, wherein said plane member is made of an amorphous magnetic material.

8. The magnetic marker according to claim 7, wherein the wire member is made of an amorphous ribbon.

9. The magnetic marker according to claim 1, wherein the wire member has a circular cross section.

10. The magnetic marker according to claim 1, wherein the second magnetic material of said plane member includes at least 50% of amorphous phase.

11. The magnetic marker according to claim 1, wherein one of said sheets comprises a flexible substrate and said plane member comprises a thin film formed on the flexible substrate, the thin film having a thickness between 0.1 and 10 μm.

12. The magnetic marker according to claim 1, wherein said plane member comprises a soft magnetic crystalline material.

13. The magnetic marker according to claim 1, wherein a number of said wire members is two.

14. The magnetic marker according to claim 1, wherein said wire member making contact to said plane member substantially shows large Barkhausen reversal against a change in magnetic field.

15. A method for manufacturing a magnetic marker comprising at least one wire member made of a first magnetic material and a plane member made of a second magnetic material, the method comprising the steps of:

forming at least one continuous wire made of a first magnetic material continuously;

forming a continuous web made of a second magnetic material which enable to have an uniaxial magnetic anisotropy;

induce the magnetic easy axis of the web to have an angle between 40° and 90° relative to a longitudinal direction of the web;

supplying a first sheet, the at least one continuous wire, the continuous web, and a second sheet in parallel;

layering the wire, the web and the two sheets so that the wire contacts substantially to the web while the wire and the web are interposed between the two sheets; and cutting the wire and web contacting to each other in magnetic markers each comprising a wire member made of a part of the wire and a plane member made of a part of the web.

16. The method according to claim 15, wherein the first or second sheet comprises a separation paper for separating the markers from the sheets interposing the wire and the web.

17. The method according to claim 15, wherein said continuous web comprises an amorphous thin film deposited on one of the first and second sheets.

* * * * *